US005992761A

United States Patent [19]

Santa Cruz et al.

[11] Patent Number: 5,992,761

[45] Date of Patent: Nov. 30, 1999

[54] COMBINATION FANCIFUL INSERT AND CONDUIT, INCLUDING METHOD OF USE

[76] Inventors: Cathy D. Santa Cruz, 401 Canyon Way, #43, Sparks, Nev. 89434; Luceal D. Fitzpatrick; Norman L. Buckles, both of P.O. Box 21483, Carson City, Nev. 89721

[21] Appl. No.: 09/078,440

[22] Filed: May 13, 1998

[51] Int. Cl.[6] ..... B05R 1/14

[52] U.S. Cl. ..... 239/211; 239/550; 239/587.1

[58] Field of Search ..... 239/17, 211, 547, 239/548, 550, 566, 567, 587.1, 588; D23/201, 214, 215, 222

[56] References Cited

U.S. PATENT DOCUMENTS

| | | | |
|---|---|---|---|
| 2,611,645 | 9/1952 | Forman | 239/211 X |
| 3,944,138 | 3/1976 | Easton | 239/211 X |
| 4,821,960 | 4/1989 | Goldman | 239/211 |
| 4,934,597 | 6/1990 | Crutcher | 239/27 |
| 5,050,801 | 9/1991 | Ferrari | 239/211 |
| 5,156,339 | 10/1992 | Gibson et al. | 239/588 X |
| 5,337,956 | 8/1994 | Crutcher | 239/27 |
| 5,836,522 | 11/1998 | Przystawik | 239/588 |

*Primary Examiner*—Lesley D. Morris

[57] ABSTRACT

A nozzle, an insert and a conduit in combination, with the nozzle being either integrally formed, or removably attached to the insert, and the insert being removably adjustably attached to the conduit. This combination allows a user to direct a substance flowing therefrom in a direction of user choice.

14 Claims, 2 Drawing Sheets

COMBINATION FANCIFUL INSERT AND CONDUIT, INCLUDING METHOD OF USE

FIELD OF THE INVENTION

The present invention relates to adjustable devices used to direct the flow of a substance exiting there from. However, this invention more particularly relates to a nozzle that is either integrally formed or attached to a fanciful insert. With the insert being removably adjustably attached to a conduit, such as a pipe or hose, and this combination allows a user to direct the substance outwardly from the insert in a direction of user choice.

BACKGROUND OF THE INVENTION

It is well known within the plumbing industry to install pipes within various exterior visual locations after the building has been completed. For example, fire sprinkler systems are often seen within public restrooms, restaurants, etc.

Other examples of exposed plumbing are seen within shower stalls, public restrooms, etc., such as those having a typical air operated body dryer therein, or the like. In most cases, the exposed plumbing is most unsightly and is definitely not pleasing to the eye. Therefore, the applicants contend there is a need for improvement within the plumbing industry to provide plumbing that is not only functional, but is also decorative, or pleasing to the eye when viewed, and allows the user to adjust the direction of the substance flowing therefrom.

The present invention is especially useful and advantageous when installed within the plumbing typically used for air operated body dryers. Wherein, the plumbing includes multiple holes there through, which are used for directing hot air therefrom.

This invention allows the user to easily adjust the direction in which the air is to be blown. Furthermore, when multiples of the present ornamental attachment device are installed within the pipe, each one may be directed at a different location of user choice. This is an important advantage, and nowhere in the prior art did the applicants find a device that addresses or resolves this problem, as does the present invention.

Yet another field or use for the present invention relates to garden hoses, particularly those having multiple holes therein for dispersing water in various directions therefrom. It is well known that such garden hoses are green in color, presumably to blend in with the grass or surrounding shrubbery. Thus, the typical garden hose is not particularly pleasing to the eye. Nor do such garden hoses allow the user to individually adjust the direction in which the water is to be dispersed. This device is very economical and provides water conservation, as the water exiting the hose can be directed exactly where needed, rather than in all directions, as taught within the prior art.

Therefore, the applicants contend that a garden hose that is not only decorative, but also includes multiple adjustable directional flow nozzles for directing a spray in various directions of choice therefrom, would be most advantageous and very useful.

It is to be noted nowhere in the prior art did the applicants find any reference which accomplishes the unusual results of the present invention. Nor did the applicants find any references that could be used as the present invention.

SUMMARY OF THE INVENTION

It is therefore an object of the present invention to provide a new and unusual adjustable insert having a nozzle therein, that can be used on substantially any conduit of choice, such as a pipe, or hose, etc. With the conduit having bores therein which are used for dispersing air, liquid, or any other substance outwardly therefrom.

It is another object of the present invention to provide an insert that is functional for dispersing air or liquid there from, and further allows a user to adjust the direction of flow therefrom.

It is yet another object of the present invention to provide an insert that includes a molded exterior surface depicting at least one fanciful object of choice thereon, and allows the user to change the object depicted thereon, if so desired.

Still another object of the present invention is to provide an insert which when used in multiples, allows a user to create personalized different combinations, or effects which are pleasing to the eye.

Another object of the present invention is to provide an insert that is economical to manufacture.

Yet another object of the present invention is to provide an insert that is easily marketable.

Yet another object of the present invention is to provide an insert that can be variably positioned within the conduit, with each position causing the substance flowing there through to be dispersed in a different direction of user choice.

Still another object of the present invention is to provide an insert that can be manufactured from substantially any suitable material of choice, such as plastic, or the like.

Also another object of the present invention is to provide an insert which is attachable to the side wall of various sized conduits having holes therein for receiving the insert therein.

Other objects and advantages will become apparent when taken into consideration with the following drawings and specification.

DETAILED DESCRIPTION OF THE DRAWINGS

Figure 1:
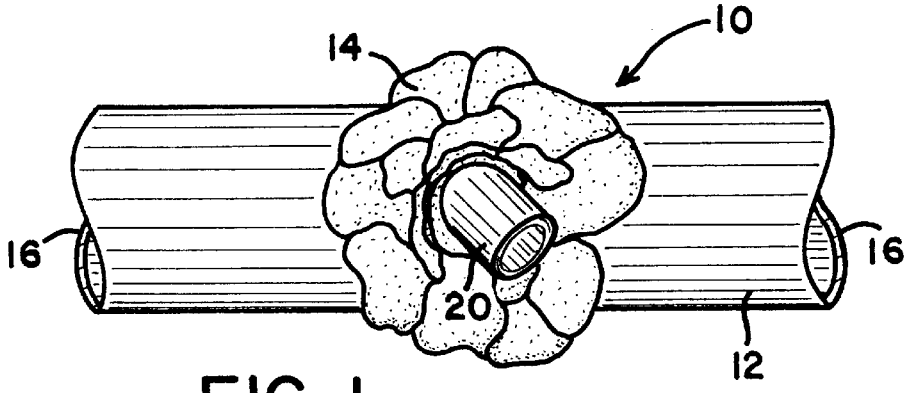
FIG. 1 is substantially an over view of the present invention.

Referring now to the drawings wherein like characters refer to like elements throughout the various views.

As shown throughout FIGS. 1–4, (arrow 10) represents an overview for the present invention, which is substantially a unique insert device used for adjustably directing the flow of a substance exiting outwardly therefrom, and which allows a user to easily adjust the direction in which the substance is to be forced.

Figure 2:
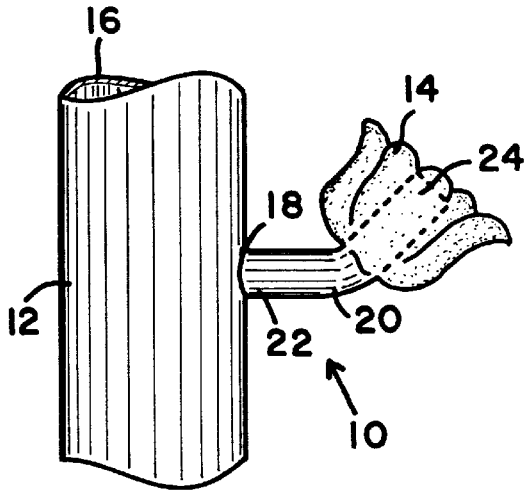
FIG. 2 is substantially a side view of the preferred embodiment for the present invention.

Within FIGS. 1 & 2, we show the preferred embodiment for the present invention, which substantially includes a conduit (12) and an insert (14).

Conduit (12) as shown within FIGS. 1–3, and 6 & 7, may be substantially any suitable member of engineering choice, which is of a shape and size to contain a substance flowing outwardly therefrom. For example, conduit (12) may be a pipe, a hose, etc., and it may be made from substantially any suitable material of choice, such as plastic, rubber, or the like. Conduit (12) further having substantially a side wall (16) that includes at least one bore (18) there through. It is to be noted in the preferred embodiment, conduit (12) includes multiples of bore (18), as seen within FIGS. 6 & 7, depending on engineering choice. Also, conduit (12) includes multiples of insert (14), if so desired. It is to be further noted that bore (18) is in open communication with the substance (not shown) flowing through conduit (12), and the substance can be substantially any suitable medium of choice, such as air, fluid, etc.

Referring now to insert (14) as seen within FIGS. 1–4, which can be made from substantially any suitable material of engineering choice, such as plastic or the like. Furthermore, insert (14) includes a molded exterior surface which can be formed into substantially any fanciful object of engineering choice, such as a flower, a tiger head, or the like. Insert (14) further includes substantially an elbow shaped nozzle (20) there through, and nozzle (20) includes an inlet end (22) and an outlet end (24).

Insert (14) can be manufactured in different embodiments of choice. For example, in FIG. 2 we show the insert (14) having the nozzle (20) being integrally formed therein, with the inlet end (22) having attachment means for removably attaching nozzle (20) to bore (18). It is to be noted that any suitable attachment means of engineering choice may be used. Such as in this embodiment, the attachment means is by inlet end (22) of nozzle (20) being frictionally removably engaged within bore (18). Whereby, conduit (12), insert (14) and nozzle (20) cooperate together to direct the substance in a direction of user choice.

Figure 3:
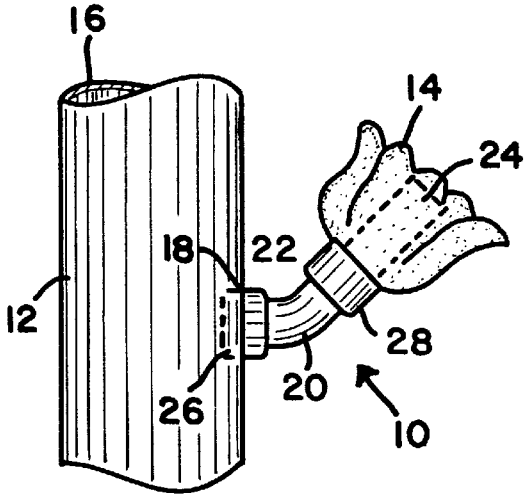
FIG. 3 is substantially a side view of a second embodiment for the present invention.

Another example of a different embodiment is represented in FIG. 3. Wherein, we show the inlet end (22) having attachment means for removably attaching nozzle (20) to bore (18). Wherein the attachment means is a fastener that is of a shape and size to be removably inserted within bore (18), and inlet end (22) of nozzle (20) is removably inserted within the fastener. It is to be noted that any suitable fastener of engineering choice may be used, such as a rubber grommet (26).

Yet another attachment means for the present invention is illustrated within FIG. 3. As shown therein, we include outlet end (24) having attachment means for removably attaching nozzle (20) to insert (14). Wherein, insert (14) includes an external protrusion (28), and outlet end (24) of nozzle (20) is of a shape and size to be frictionally engaged within protrusion (28).

Figure 4:
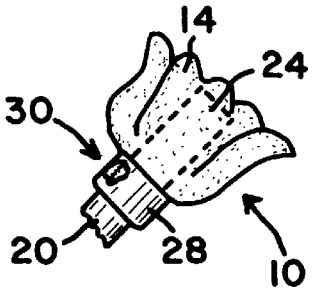
FIG. 4 is substantially a partial side view showing a different means to attach the insert.

Still further, as illustrated within FIG. 4, a different attachment means may include the above noted protrusion (28) of insert (14) having internal threads and outlet end (24) having external threads. Thus, outlet end (24) is threadably engaged within protrusion (28), as represented by arrow (30).

It will now be seen within FIGS. 1–4, the device allows the user to easily determine the direction in which the substance is to be forced. For example, lets presume the device (arrow 10) is used within the plumbing of a typical air operated body dryer. Wherein, the plumbing, or conduit (12) of the present invention is installed within a shower stall, and multiples of the present invention are inserted within the conduit (12). The user after activating the body dryer, is desirous of directing the air flow toward a specific part of their body, such as toward their head so as to dry their hair. However, one of the nozzle's (20) of the installed inserts is not currently directed there. Thus, the user may easily grasp the desired insert and pull the insert (14) from within the bore (18), then turn the nozzle (20) toward the desired direction, and re-insert the device. Therefore, the nozzle (20) within the insert (14) is now in a position that allows the air flowing there from, to dry their hair.

It will further be seen that if the user desires different designs to be intermixed, such as roses, or tigers, or the like, this is easily achieved by removing or inserting different inserts (14) at various locations of choice within conduit (12). Thus, various visual effects are easily achieved depending on user choice.

Figure 6:
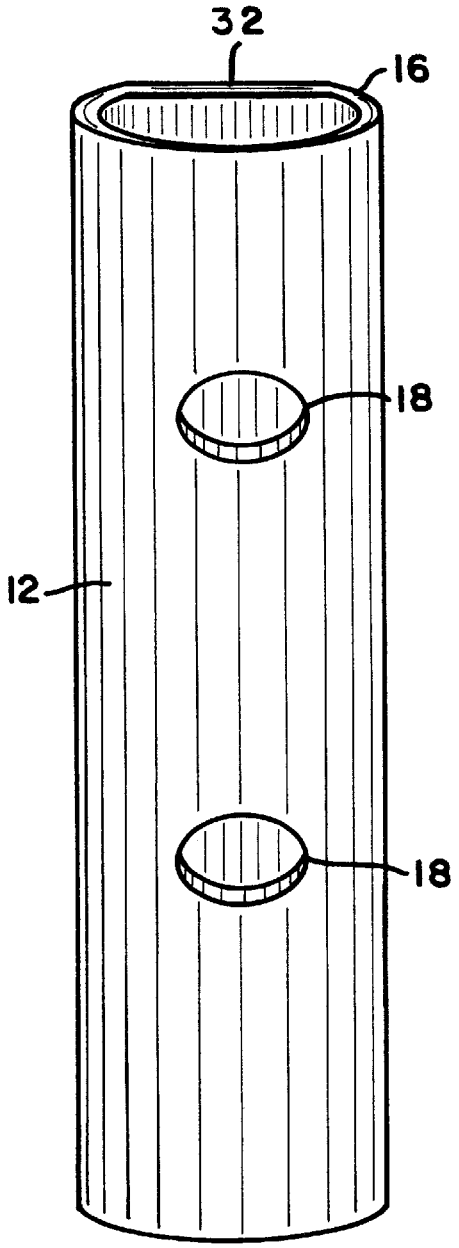
FIG. 6 is substantially a perspective view of the preferred embodiment for a conduit.
Figure 7:
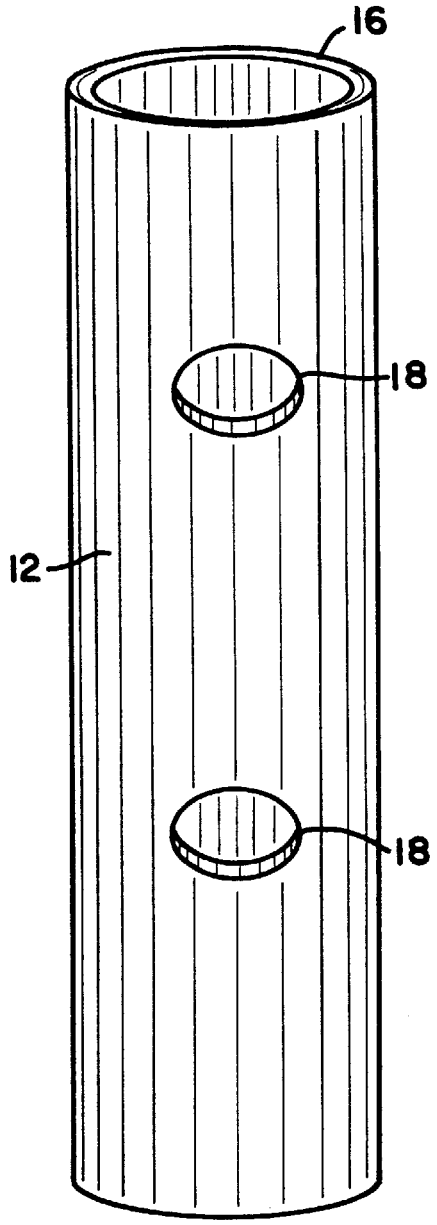
FIG. 7 is substantially a perspective view of a second embodiment for a conduit.

As illustrated within FIG. 6, it is to be noted that if the conduit (12) is installed within a shower, as described above, the conduit (12) may be formed having a flat edge (32) if so desired. This allows the conduit (12) to be easily installed in a flush manner within the shower stall, or the like. This configuration is not only pleasing to eye, but is functional as it conserves space.

Figure 5:
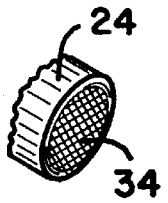
FIG. 5 is substantially a partial perspective view showing a nozzle outlet end, having a screen therein.

Referring now to a different use for the present invention, wherein the device is easily used as a garden hose. For example, the present invention when used as a garden hose, allows the user to position the conduit (12) at a location of choice within the garden, or the like. Thereafter, direct the nozzles (20) in a specific direction of choice, such as toward a bush. Thus, when each nozzle (20) is pointed in the direction of choice. The user then turns on the water and proceeds to water as usual. It is to be noted this use includes the exact type of device, namely the conduit (12) which is a hose, and multiple nozzles (20). However, to achieve a spray pattern, rather than a direct flow, we include a screen (34), see FIG. 5. It is to be noted that any screen (34) of engineering choice may be used, and any type of attachment means of engineering choice may be used. For example, screen (34) may be frictionally engaged within outlet end (24) of nozzle (20), if so desired. It will now be seen that the present device easily functions as a garden hose, if so desired.

It is to be further noted we herein provide a method of use for the present invention that includes the following steps of:

a. positioning conduit (12) at a location of choice;

b. locating a bore (18) within the side wall (16) of conduit (12);

c. grasping an insert (14);

d. determining the desired direction for flow of a substance;

e. aligning the nozzle (20) of insert (14) so as to direct the substance flowing therefrom in the desired direction; and;

f. inserting the insert (14) into bore (18).

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

What we claim as new and wish to secure by Letters Patent is:

1. A device for adjustably directing the flow of a substance comprising: a conduit; and an insert having an integrally formed elbow shaped nozzle therethrough; said nozzle having an inlet end, said conduit being of a shape and size to contain a substance flowing outwardly therefrom, said conduit having a side wall, said wall having at least one bore therethrough, said bore being in open communication with said substance, and said inlet end being frictionally removably engaged within said bore, whereby;

said conduit, and insert cooperate together to direct said substance in a direction of user choice.

2. The device of claim 1 wherein said conduit includes multiples of said bore, and multiples of said insert.

3. A device for adjustably directing the flow of a substance comprising; a conduit; an insert; and a removable elbow shaped nozzle; said conduit being of a shape and size to contain a substance flowing therefrom, said conduit having a side wall, said wall having at least one bore there through, said bore being in open communication with said substance, said nozzle having an inlet end and an outlet end, said inlet end having attachment means for removably attaching said nozzle to said bore, and said outlet end having attachment means for removably attaching said nozzle to said insert, whereby;

said conduit, said nozzle, and said insert cooperate together to direct said substance in a direction of user choice.

4. The device of claim 3 wherein said conduit is a pipe.

5. The device of claim 3 wherein said conduit is a hose.

6. The device of claim 3 wherein said substance is air.

7. The device of claim 3 wherein said substance is fluid.

8. The device of claim 3 wherein said inlet end having attachment means for removably attaching said nozzle to said bore is by said inlet end being frictionally engaged within said bore.

9. The device of claim 3 wherein said inlet end having attachment means for removably attaching said nozzle to said bore includes a fastener which is of a shape and size to be removably inserted within said bore, and said inlet end of said nozzle being removably inserted within said fastener.

10. The device of claim 9 wherein said fastener is a grommet.

11. The device of claim 3 wherein said outlet end having attachment means for removably attaching said nozzle to said insert includes said insert having an external protrusion, and said outlet end is of a shape and size to be frictionally engaged within said protrusion.

12. The device of claim 3 wherein said outlet end having attachment means for removably attaching said nozzle to said insert includes said outlet end having external threads, said insert includes an external protrusion having internal threads, and said outlet end being threadably engaged within said protrusion.

13. The device of claim 3 includes multiples of said insert and multiples of said bore.

14. The device of claim 3 includes said outlet end having a screen therein, whereby, said device functions as a garden hose.

* * * * *